US009932771B1

(12) United States Patent
Bramwell et al.

(10) Patent No.: US 9,932,771 B1
(45) Date of Patent: Apr. 3, 2018

(54) LADDER SAFETY RAILS

(71) Applicants: Michael R. Bramwell, Guilford, CT (US); Kevin Sheard, Guilford, CT (US)

(72) Inventors: Michael R. Bramwell, Guilford, CT (US); Kevin Sheard, Guilford, CT (US)

(73) Assignee: SAFETY SOLUTIONS, INC., West Haven, CT (US)

( * ) Notice: Subject to any disclaimer, the term of this patent is extended or adjusted under 35 U.S.C. 154(b) by 0 days.

(21) Appl. No.: 14/978,048

(22) Filed: Dec. 22, 2015

Related U.S. Application Data

(60) Provisional application No. 62/095,370, filed on Dec. 22, 2014.

(51) Int. Cl.
*E06C 7/18* (2006.01)
*E06C 7/48* (2006.01)

(52) U.S. Cl.
CPC ..... *E06C 7/181* (2013.01); *E06C 7/48* (2013.01)

(58) Field of Classification Search
CPC ..... A62B 1/10; F16B 5/0225
See application file for complete search history.

(56) References Cited

U.S. PATENT DOCUMENTS 626,839 A * 6/1899 Lyke ..... E06C 7/182 182/106
636,507 A * 11/1899 Eichler ..... E06C 7/182 182/106
922,306 A * 5/1909 Mead ..... E06C 7/182 182/106
995,273 A * 6/1911 Mead ..... E06C 7/182 182/106
1,191,922 A * 7/1916 Pyle ..... E06C 1/387 182/161
2,327,317 A * 8/1943 Randall ..... E06C 7/44 182/107
2,439,430 A * 4/1948 Hurd ..... E06C 1/36 182/206
2,881,028 A * 4/1959 Baird ..... E06C 7/16 182/113
2,934,163 A * 4/1960 Ladewski ..... E06C 7/48 182/111
3,139,155 A * 6/1964 Skeels ..... E06C 7/182 182/106

(Continued)

FOREIGN PATENT DOCUMENTS

CH 116778 A * 2/1927 ..... E06C 7/42
CH 116778 A * 2/1927 ..... E06C 7/42

(Continued)

*Primary Examiner* — Katherine W Mitchell
*Assistant Examiner* — Candace L Bradford
(74) *Attorney, Agent, or Firm* — DeLio, Peterson & Curcio, LLC; Thomas E. Ciesco

(57) ABSTRACT

A collapsible ladder safety system for a ladder having first and second vertical ladder rail and a plurality of step rungs extending between the first and second vertical rails, the system comprising first and second upright tubular hand rails and a cross member pivotally attached to each of the first and second parallel upright tubular hand rails. The tubular hand rails or cross member are releasably securable to an upper end of the ladder. The first and second upright tubular hand rails are collapsible against the cross member when not secured to the ladder.

17 Claims, 8 Drawing Sheets

(56) References Cited

U.S. PATENT DOCUMENTS 3,157,248 A * 11/1964 Nesslinger ..... E06C 1/39 182/102
3,459,277 A * 8/1969 Frederick ..... E06C 7/48 182/214
3,902,700 A * 9/1975 Cox ..... E06C 1/34 182/102
4,061,203 A * 12/1977 Spencer ..... E06C 7/48 182/214
4,164,269 A * 8/1979 Jackson ..... E06C 7/48 182/107
4,202,428 A * 5/1980 Hickman ..... E06C 1/20 182/162
4,502,566 A * 3/1985 Wing ..... E06C 7/48 182/107
4,998,982 A * 3/1991 Arnold ..... E06C 1/12 182/107
5,261,507 A * 11/1993 Williams ..... E06C 7/48 182/214
5,373,913 A * 12/1994 Santos ..... E06C 7/44 182/107
5,941,343 A 8/1999 Kelsey
6,012,546 A 1/2000 Bee et al.
6,394,229 B1 * 5/2002 Hastreiter ..... E06C 1/12 182/107
6,397,644 B1 * 6/2002 Gidding ..... B60R 9/0485 182/127
6,457,559 B1 * 10/2002 Schlueter ..... E06C 1/383 182/159
6,739,349 B2 * 5/2004 Kastenschmidt ..... A01J 9/00 137/15.16
7,066,299 B1 * 6/2006 Fleming ..... E06C 1/20 182/107
8,235,175 B1 * 8/2012 Feldhaus ..... 182/106
8,602,163 B2 12/2013 Davis, Jr.
8,839,907 B2 * 9/2014 Davis, Jr. ..... E06C 7/182 182/106
8,839,908 B2 9/2014 Davis, Jr.
2005/0236227 A1 * 10/2005 Clark ..... E06C 7/182 182/106
2006/0261623 A1 * 11/2006 Kuznarik ..... B60R 3/02 296/62
2008/0190692 A1 * 8/2008 Feik ..... E06C 7/182 182/107
2012/0012423 A1 * 1/2012 Murphy ..... E06C 1/383 182/96
2012/0061181 A1 * 3/2012 Onobrakpeya ..... E06C 1/005 182/159
2012/0175188 A1 7/2012 Xu
2013/0199874 A1 * 8/2013 Davis, Jr. ..... E06C 7/188 182/107
2014/0159410 A1 * 6/2014 Rasmussen ..... A47C 19/20 296/24.33

FOREIGN PATENT DOCUMENTS

FR 1193183 A * 10/1959 ..... E06C 7/48
FR 1193183 A * 10/1959 ..... E06C 7/48
FR 1390439 A * 2/1965 ..... E06C 1/04
FR 1390439 A * 2/1965 ..... E06C 1/04
FR 2889240 A1 * 2/2007 ..... E06C 1/04
FR 2889240 A1 * 2/2007 ..... E06C 1/04
WO WO 2004001176 A1 * 12/2003 ..... E06C 1/22
WO WO-2004001176 A1 * 12/2003 ..... E06C 1/22

* cited by examiner

LADDER SAFETY RAILS

BACKGROUND OF THE INVENTION

1. Field of the Invention

The present invention relates to a system and method for using safety rails for a ladder and more specifically, adjustable safety rails mountable to an extension ladder.

2. Description of Related Art

Stabilizers for ladders may provide extra support in maintaining a ladder in a specific position against a structure. The stabilizer may also provide a usable space between the ladder and the surface of the structure, such as when a painter needs to paint the surface on which the ladder is rested. However, the stabilizer provides stabilization for the ladder, not for the user. When a user needs to stabilize themselves on a ladder, the ladder rails or surface to which it leans are the only options. Moreover, when a user reaches the top portion of the ladder and must step off one of the top rungs, the user must balance themselves during that movement, sacrificing the safety of the user.

SUMMARY OF THE INVENTION

Bearing in mind the problems and deficiencies of the prior art, it is therefore an object of the present invention to provide a ladder safety system which allows a user to safely dismount the ladder from the top of the ladder by providing additional support.

It is another object of the present invention to provide the user with the stability and confidence to make a smooth, safe transition from the ground or base level to firm footed position on an elevated surface.

A further object of the invention is to provide stability while using the ladder as the platform while performing specific tasks.

It is yet another object of the present invention to provide a ladder safety system which when not in use, collapses to a compact footprint for transport and storage.

It is still another object of the present invention to provide a ladder safety system which allows a user to adjust the position of hand rails above the top of the ladder.

It is another object of the present invention to provide a fastener assembly which secures a cylindrical member to a surface in a rotatable or non-rotatable state.

Still other objects and advantages of the invention will in part be obvious and will in part be apparent from the specification.

The above and other objects, which will be apparent to those skilled in the art, are achieved in the present invention which is directed to a collapsible ladder safety system for a ladder having first and second vertical ladder rail and a plurality of step rungs extending between the first and second vertical rails, the system comprising first and second upright tubular hand rails and a cross member pivotally attached to each of the first and second parallel upright tubular hand rails, the tubular hand rails or cross member being releasably securable to an upper end of the ladder. The first and second upright tubular hand rails are collapsible against the cross member when not secured to the ladder. The collapsible ladder safety system may include a curved portion at an upper end of the first and second upright tubular hand rail. The collapsible ladder safety system may include a first and second pair of pivot clamps, the pivot clamps including a circular sleeve slidingly attached to the upright tubular member and a pin extending outward from the circular sleeve into an opening on the cross member. The collapsible ladder safety system may include a tension knob attached to each pivot clamp for adjusting the friction between the circular sleeve and the upright tubular member. The collapsible ladder safety system may include a lower brace member pivotally attached to each of the first and second upright tubular members, the lower brace member being parallel to the cross member. The first and second upright tubular members may be nearly parallel to the cross member when the system is in a closed position and the first and may be perpendicular to the cross member when the system is an opened position with the upright tubular hand rails fully secured to the ladder. The collapsible ladder safety system may include a support arm extending from each end of the cross member toward a surface for which the ladder is meant to lean against.

Another embodiment of the present invention is directed to a collapsible ladder safety system for a ladder having first and second vertical ladder rail and a plurality of step rungs extending between the first and second vertical rails, the system comprising first and second upright tubular hand rails, a curved portion at an upper end of the first and second upright tubular hand rail, and a cross member pivotally attached to each of the first and second upright tubular hand rails, the tubular hand rails or cross member being releasably securable to an upper end of the ladder. The collapsible ladder safety system may include a support arm extending from each end of the cross member toward a support wall for which the ladder is meant to lean against. The collapsible ladder safety system includes a lower brace member pivotally attached to each of the first and second upright tubular members, the lower brace member being parallel to the cross member, a first and second pair of pivot clamps, the pivot clamps including a circular sleeve slidingly attached to the upright tubular member and a pin extending outward from the circular sleeve into an opening on the cross member or the lower brace, and a tension knob attached to each pivot clamp for adjusting the friction between the circular sleeve and the upright tubular member. The first and second upright tubular members are nearly parallel to the cross member when the system is in a closed position and the first and second upright tubular hand rails are perpendicular to the cross member when the system is an opened position. The cross member may be attachable to the ladder rails or to at least one of the ladder step rungs. The upright tubular hand rails may be rotatable within the circular sleeve and rotation tension may be adjustable with the tension knob. The upright tubular hand rails may be vertically slidable within the circular sleeve and slide tension may be adjustable with the tension knob. The upright tubular hand rails may extend below the support arms and may be spaced away from the ladder rails sufficient for a user to grasp around the entire circumference of the tubular hand rail. The upright tubular hand rails may extend below the lower brace member.

Another embodiment of the present invention is directed to a method for using a collapsible ladder safety system for a ladder having first and second vertical ladder rail and a plurality of step rungs extending between the first and second vertical rails. The method comprises providing first and second parallel upright tubular hand rails, a curved portion at an upper end of the first and second parallel upright tubular hand rail, a cross member pivotally attached to each of the first and second upright tubular hand rails, a support arm extending from each end of the cross member toward a support wall for which the ladder is meant to lean against, a lower brace member pivotally attached to each of the first and second upright tubular hand rails, the lower brace member being parallel to the cross member, a first and second pair of pivot clamps, the pivot clamps including a circular sleeve slidingly attached to the upright tubular member and a pin extending outward from the circular sleeve into an opening on the cross member or the lower brace and a tension knob attached to each pivot clamp for adjusting the friction between the circular sleeve and the upright tubular hand rail. The method includes moving the first and second upright tubular hand rails from a closed position wherein the first and second upright tubular hand rails are nearly parallel to the cross member to a second open position wherein the first and second upright tubular hand rails are perpendicular to the cross member. The method includes securing the first and second upright tubular hand rails or the cross member to an upper portion of the ladder, placing the support arms against a wall or roof and adjusting the first and second parallel upright tubular hand rails to provide support for a user. The method may include the step of removing the first and second upright tubular hand rails or the cross member from the upper portion of the ladder when the user is finished using the ladder. The method may include the step of moving the first and second upright tubular hand rails from the second position to the first closed position.

Another embodiment of the present invention is directed to the collapsible ladder safety system as described above in combination with a fastening assembly for securing a cylindrical member to a surface, the fastening assembly comprising a cylindrical riser having a length and a central opening extending axially through the length of the cylinder. The cylindrical riser comprises a circular aperture having a diameter larger than diameter of the central opening, the circular aperture extending from a top end of the cylindrical riser to a distance less than the length of the cylindrical riser, a first cylindrical groove extending across the top surface of the cylindrical riser and a second cylindrical groove co-axially aligned with the first cylindrical groove and having a diameter larger than the first cylindrical groove. The fastening assembly includes a spring disposed in the aperture and a ring having a shaft extending radially from an arc of the ring, the shaft including external threads at a distal end thereof, the shaft extending through the spring, the cylindrical riser central opening and an opening in the surface to which the cylindrical member is secured. The fastening assembly includes a tension knob engagable with the threads of the shaft wherein the tension knob is disposed on the opposite side of the surface than the cylindrical riser. The ring is fully engaged with the second cylindrical groove when the fastening assembly is in a tightened position and the ring is partially engaged with the second cylindrical groove when the fastening assembly is in a loosened position. The cylindrical member is rotatable about the opening in the surface when the fastening assembly is in the loosened position and the cylindrical member is non-rotatably secured to the surface when the fastening assembly is in the tightened position.

Another embodiment of the present invention is directed to a fastening assembly for securing a cylindrical member to a surface, the fastening assembly comprising a cylindrical riser having a length and a central opening extending axially through the length of the cylinder. The cylindrical riser comprises a circular aperture having a diameter larger than diameter of the central opening, the circular aperture extending from a top end of the cylindrical riser to a distance less than the length of the cylindrical riser. The cylindrical riser comprises a first cylindrical groove extending across the top surface of the cylindrical riser and a second cylindrical groove co-axially aligned with the first cylindrical groove and having a diameter larger than the first cylindrical groove. The cylindrical riser comprises a spring disposed in the aperture, a ring having a shaft extending radially from an arc of the ring, the shaft including external threads at a distal end thereof, the shaft extending through the spring, the cylindrical riser central opening and an opening in the surface to which the cylindrical member is secured, and a tension knob engagable with the threads of the shaft wherein the tension knob is disposed on the opposite side of the surface than the cylindrical riser. The ring is fully engaged with the second cylindrical groove when the fastening assembly is in a tightened position and the ring is partially engaged with the second cylindrical groove when the fastening assembly is in a loosened position. The cylindrical member is rotatable about the opening in the surface when the fastening assembly is in the loosened position and the cylindrical member is non-rotatably secured to the surface when the fastening assembly is in the tightened position.

Another embodiment of the present invention is directed to a method of securing a cylindrical member to a surface comprising providing the fastening assembly as described above, providing a surface and a cylindrical member to secure to the surface and ensuring the ring shaft extends through the spring, riser opening and an opening in the surface. The method includes engaging the tension knob with the threads of the shaft, sliding the cylindrical member through the ring, tightening the tension knob until the cylindrical member is prevented from sliding through the ring and the rotating about the surface opening and partially loosening the tension knob to allow the cylindrical member to slide through the ring and rotate about the surface opening.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-15 of the drawings in which like numerals refer to like features of the invention.

Figure 1:
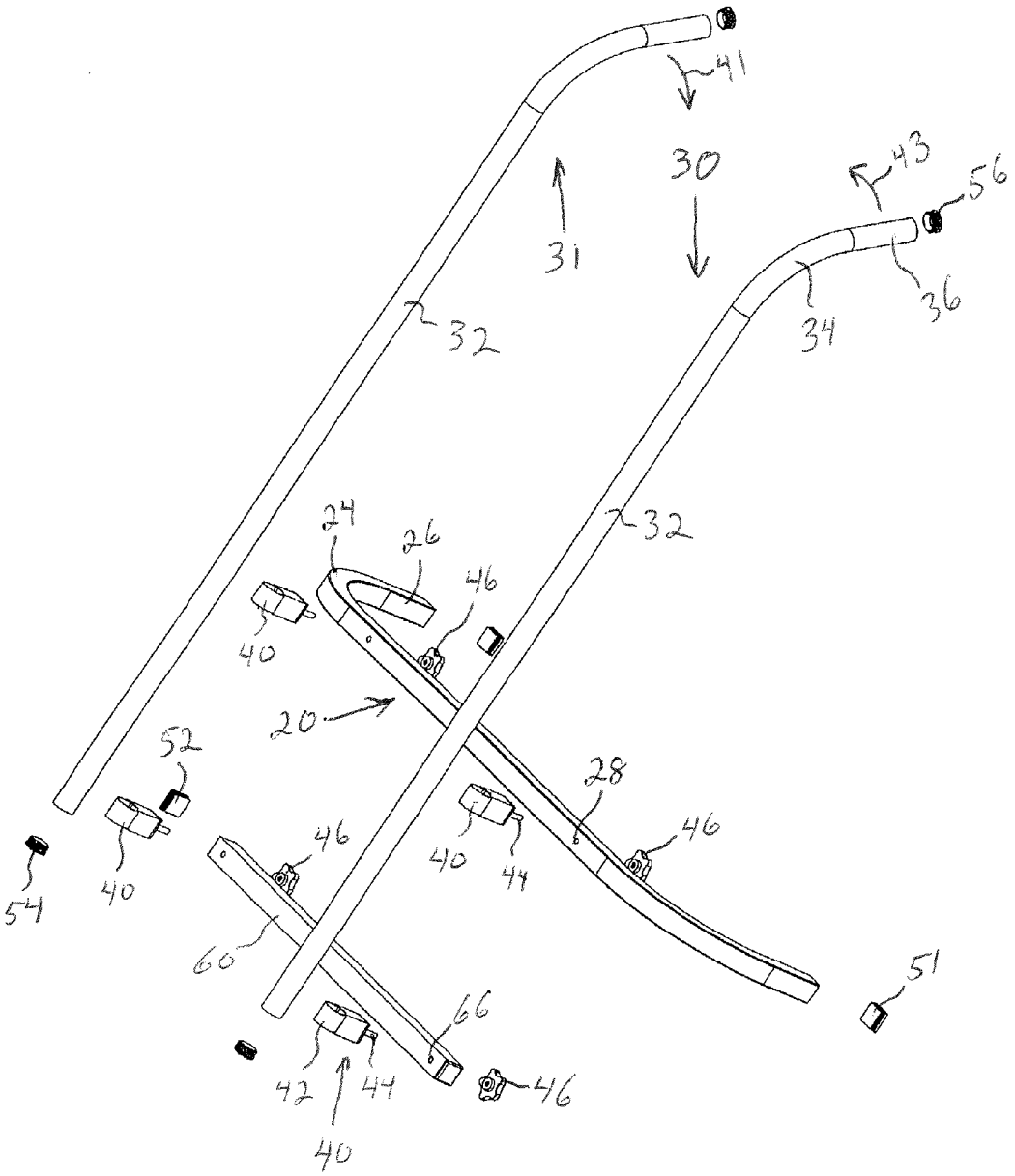
FIG. 1 is an exploded perspective view of the ladder safety system according to the present invention.
Figure 4:
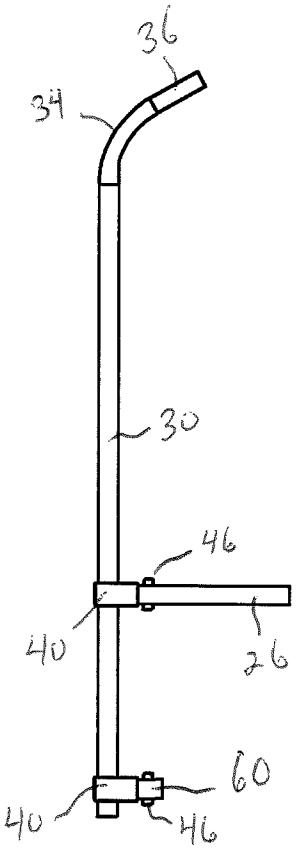
FIG. 4 is a side elevational view of the ladder safety system shown in FIG. 1.
Figure 3:
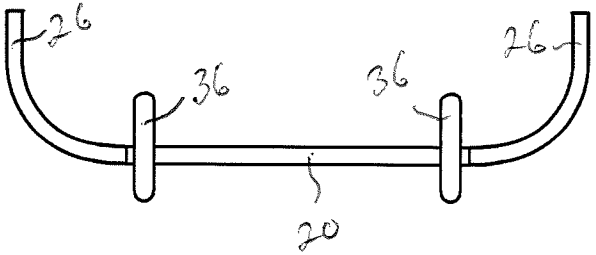
FIG. 3 is a top elevational view of the ladder safety system shown in FIG. 1.
Figure 2:
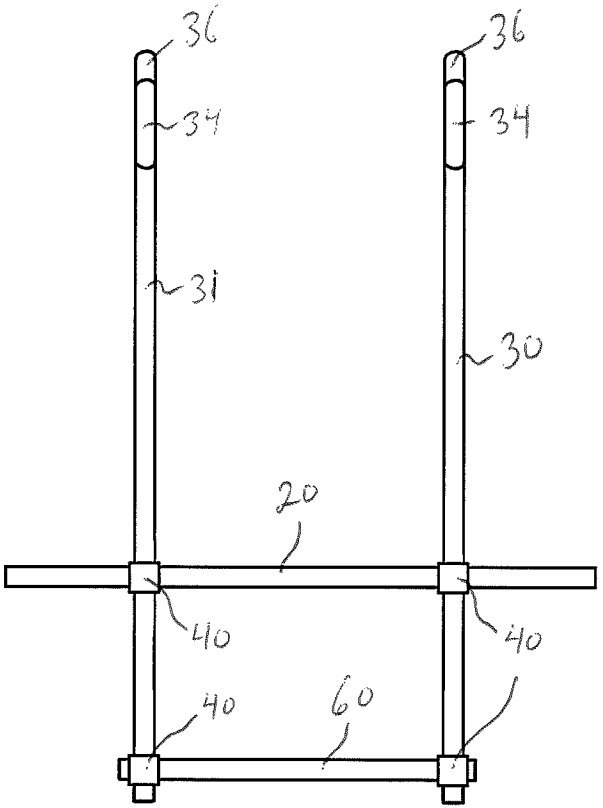
FIG. 2 is a front elevational view of the ladder safety system shown in FIG. 1.

The ladder safety system as shown in the exploded view of FIG. 1 and the elevational views of FIGS. 2-4 includes a cross member 20 removably securable to a ladder and a lower brace 60 securable to the ladder below the cross member 20. A pair of hand rails 30 are attached to the cross member 20 and the lower brace 60, the hand rails 30, 31 including a upright tubular member 32 and a curved portion 34 extending from an upper end of each upright tubular member 32. Extending from the curved portion 34 is a straight handle portion 36. The upright tubular members 32 are pivotally attached to the cross member 20 and the lower brace 60 with pivot clams 40 which include a circular sleeve 42 slidingly attached to the upright tubular member 32 and a shaft 44 extending outward from the circular sleeve 42 and through an opening 28 on the cross member 20 or an opening 66 on the lower brace 60. The shaft 44 may be threaded so that female threads on a tension knob 46 engage the shaft 44. Tightening the tension knob 46 on the shaft 44 prevents the pivot clamps 40 from rotating on the cross member 20 or lower brace 60. The hand rails 30, 31 may also rotate separately and independently of one another about the upright tubular member cylindrical axis 98 in the directions indicated by rotation arrow 80 as shown in FIG. 8.

The cross member 20 is an elongated tube or bar 22 with a curved portion 24 and a support arm 26 extending perpendicular to the elongated bar 20 at each end of the elongated bar 20. Support arm end caps 51 may be disposed on the distal end of the support arm 26. Alternately, a boot or other covering may be placed on the outside of support arm 26 for protecting the surface to which the support arm 26 is to be placed against. The boot may also help in preventing the ladder from sliding sideways. Bottom end caps 54 may be disposed on the bottom end of the hand rails 30 and handle end caps 56 may be disposed on the open ends of the straight handle portion 36.

Figure 5:
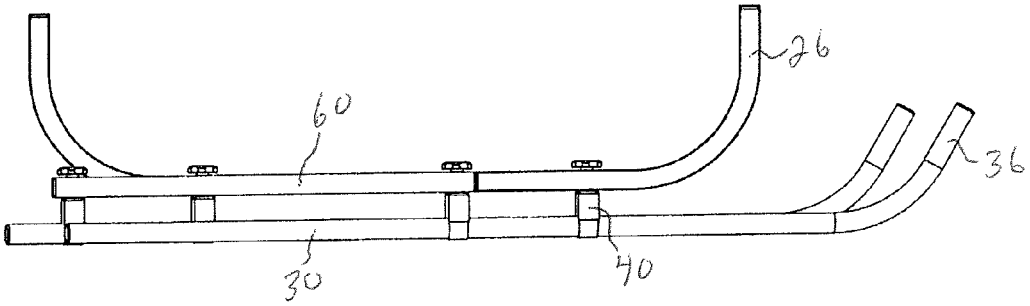
FIG. 5 is a bottom elevational view of the ladder safety system with the hand rails in a closed position.
Figure 6:
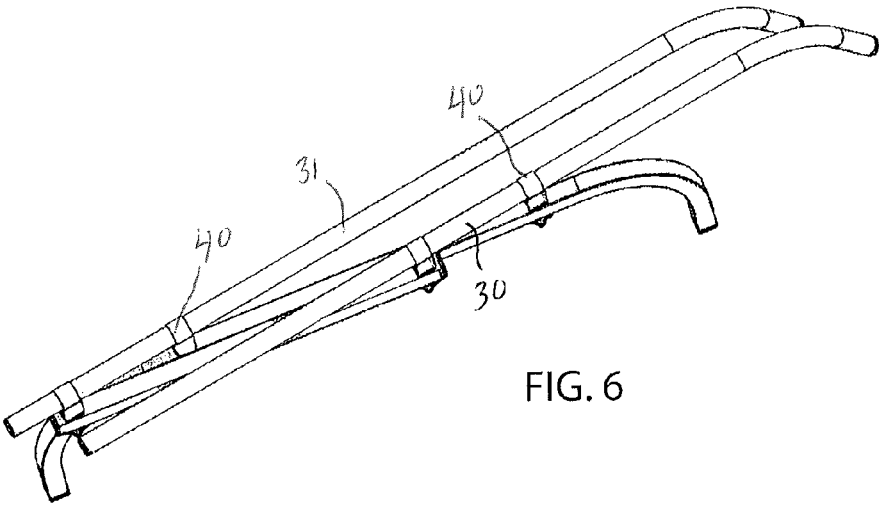
FIG. 6 is a perspective view of the ladder safety system in a closed position.
Figure 7:
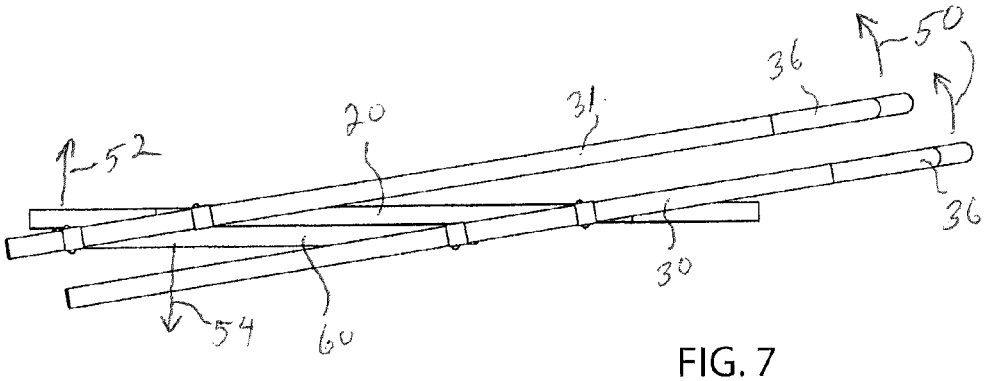
FIG. 7 is a front elevational view of the ladder safety system showing the direction of movement in preparing the system for use.

To transport the ladder safety system when not attached to the ladder, the cross member 20 and hand rails 30, 31 are folded against each other. FIGS. 5 and 6 show the ladder safety system in a fully collapsed position wherein the longitudinal axes of cross member 20, lower brace 60 and upright tubular members 32 are within an angle of about 10°, dependent upon the position of the pivot clams on the upright tubular member, and substantially parallel to one another. FIG. 7 shows the ladder safety system being opened with the hand rails 30, 31 rotating clockwise in the direction of arrows 50 about the pivot clamps 40 and the cross member 20 and lower brace 60 moving away from one another in the direction of arrows 52, 54. The cross member 20 and lower brace 60 maintain a relative parallel position independent of the state of collapse of the ladder safety system. The upright tubular members 32 also maintain a parallel position relative to one another.

Figure 8:
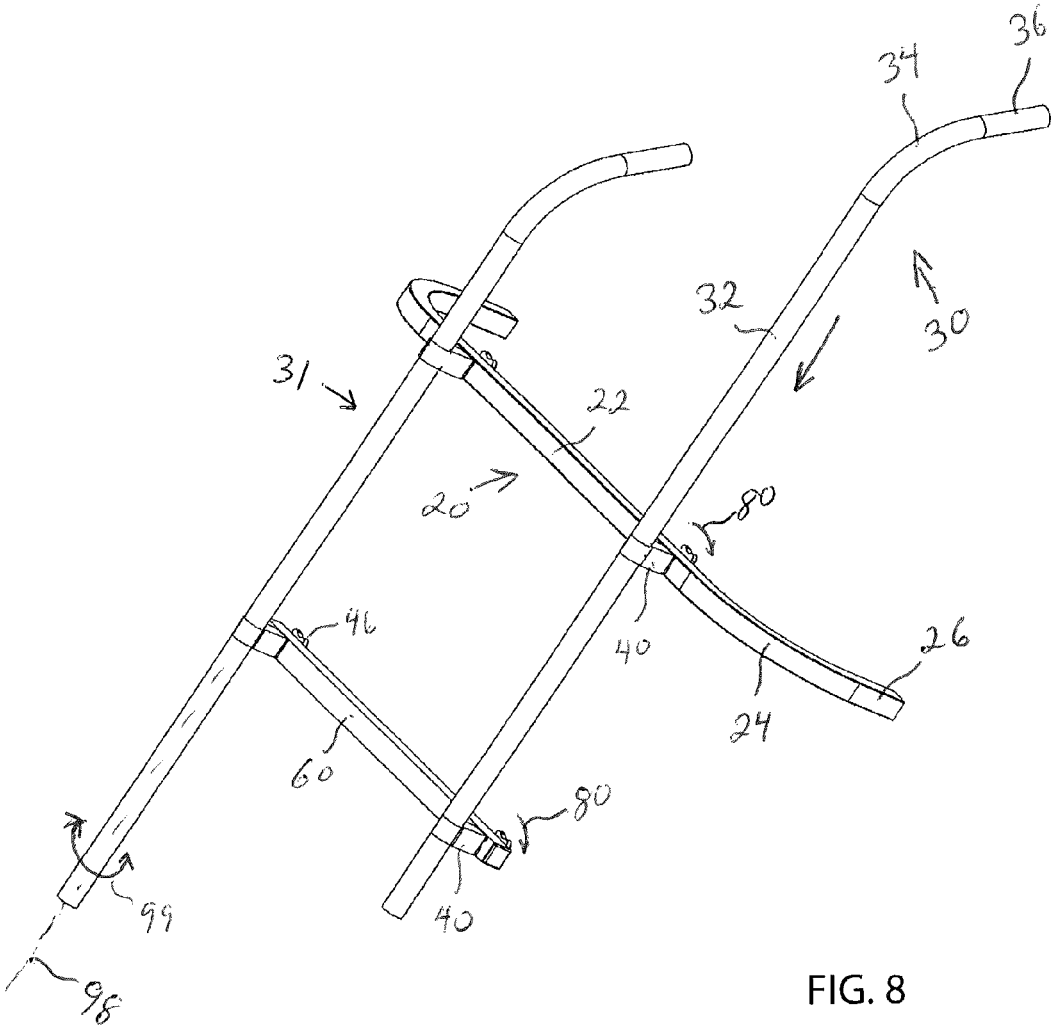
FIG. 8 is a perspective view of the ladder safety system in a fully open position.

FIG. 8 shows the ladder safety system in an open position with hand rail 31 lower than hand rail 30. The skewed relative position of the hand rails 30, 31 in the open position allows the ladder safety system to be more compact when in the closed position. Once the system is unfolded, the tension knobs 46 on hand rail 31 are loosened by rotating in the direction of arrow 80 and the hand rail 31 may be moved upward to the same position as hand rail 30, or it may be moved to a different extended position, depending on the needs of the user. The ladder system may then be mounted to an upper portion of the ladder with a pair of U-bolts securing the cross member to one of the ladder step rungs and securing the lower brace 60 to a lower ladder step rung. Alternately, the cross member 20 and the lower brace 60 may be secured to the ladder rails.

To descend from the elevated surface, the user may grab the left or right hand rail while in a backward position. The user may orient himself with the elevated surface and the top rung of the ladder. With his free hand, the user may grab the other hand rail and start the descent. As the user reaches the bottom of the hand rails, the user would transition his hands back to the ladder and complete the descent.

If the hand rails 30, 31 are not needed for a particular task, the two hand rails may be removed, leaving the cross member 20 to support the ladder against the vertical surface which the support arms 26 contact.

Figure 9:
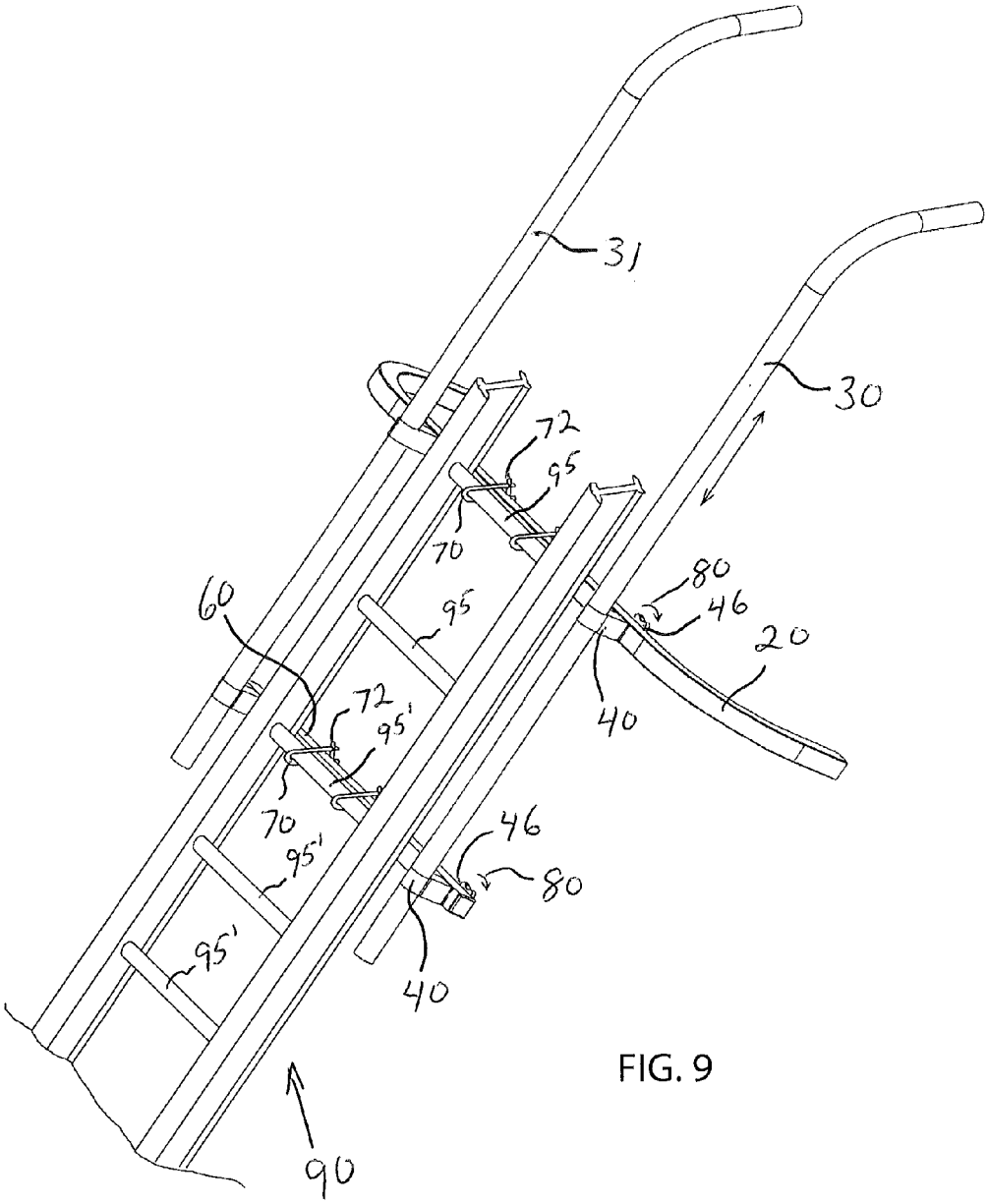
FIG. 9 is a perspective view of the ladder safety system mounted on a ladder.

In a method of using the ladder safety system, the system shown mounted on the upper end of a ladder 90 in FIG. 9, a user begins with the system in a folded position wherein the cross member, lower brace member and first and second hand rails being substantially parallel to one another as shown in FIG. 6. The tension knobs 46 are loosened to allow the pivot clamps 40 to rotate about the pivot clamp shaft. The hand rails 30, 31 are rotated until they are perpendicular to the cross member 20. The ladder safety system is placed on the ground with the support arms 26 contacting the ground. The ladder 90 is then placed on top of the ladder safety system with an upper ladder step rung 95 placed adjacent the cross member 20 and a lower step rung 95' adjacent the lower brace. A pair of U-bolts 70 and U-bolt straps 72 secure the cross member 20 to an upper ladder step rung 95 and a pair of U-bolts 70' and U-bolt straps 72' secure the lower brace 60 one of the lower step rungs 95'. The tension knobs 46 may be tightened while the ladder is on the ground to prevent the hand rails from rotating relative to the cross member 20 and cross brace 60. The ladder 90 is lifted upright and placed in the desired position.

This configuration now allows the user to climb the ladder in the normal fashion. As the user reaches the bottom of the hand rails, the hands transition from the ladder to the hand rails 30, 31 as the user ascends. The user may alternately transition hand placement from the ladder to the elevated surface while holding on to the hand rails 30, 31. Once firm footing is established, the user can release his or her grip from the hand rails 30, 31. The hand rails 30, 31 may be rotated as shown by the rotation arrows 41, 43 in FIG. 1, so that the straight handle portions 36 are in different respective rotational orientations, such as facing in the direction of one another so that they are essentially planar. This position allows for more compact storage as well as allowing a ladder to be placed closer to a surface when the straight handle portions 36 are below the roof line. The straight handle portions 36 may be rotated forward so that the hand rails 30, 31 may be extended upward without the straight handle portions 36 contacting or getting in the way of the support surface to which the ladder is leaned against.

The ladder safety system may also be used with only one hand rail attached, or one hand rail completely retracted to a shorter length than the other. Hand rail 30 or hand rail 31 may be removed by rotating the tension knobs 46 off the pivot clamp shaft 44 and removing the pivot clamps or by releasing the tension on the tension knobs 46 and sliding the hand rail 30 or hand rail 31 from the pivot clamp circular sleeve 42.

For removal of the ladder safety system from the ladder 90, the ladder 90 may be placed so the system is easily accessible, such as placing the ladder 90 along the ground. The U-bolts 60 and securing plate 72 are removed from the cross member 20 and the lower brace 60. The ladder 90 may then be lifted from the ladder safety system or the ladder safety system may be lifted from the ladder 90, depending on the position of the ladder 90 on the ground. The tension knobs 46 are then rotated counter clockwise until the tension is released. The ladder safety system may then be collapsed by rotating the hand rails 30, 31 about the pivot clamp shaft 44.

Figure 10:
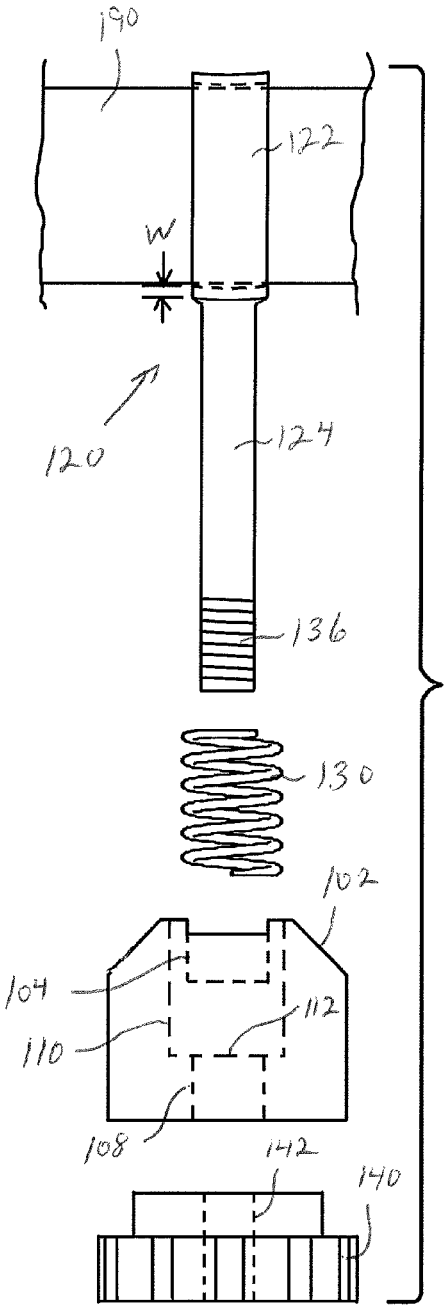
FIG. 10 is an exploded side view of the fastening assembly according to the present invention, shown with an attached cylindrical member.
Figure 11:
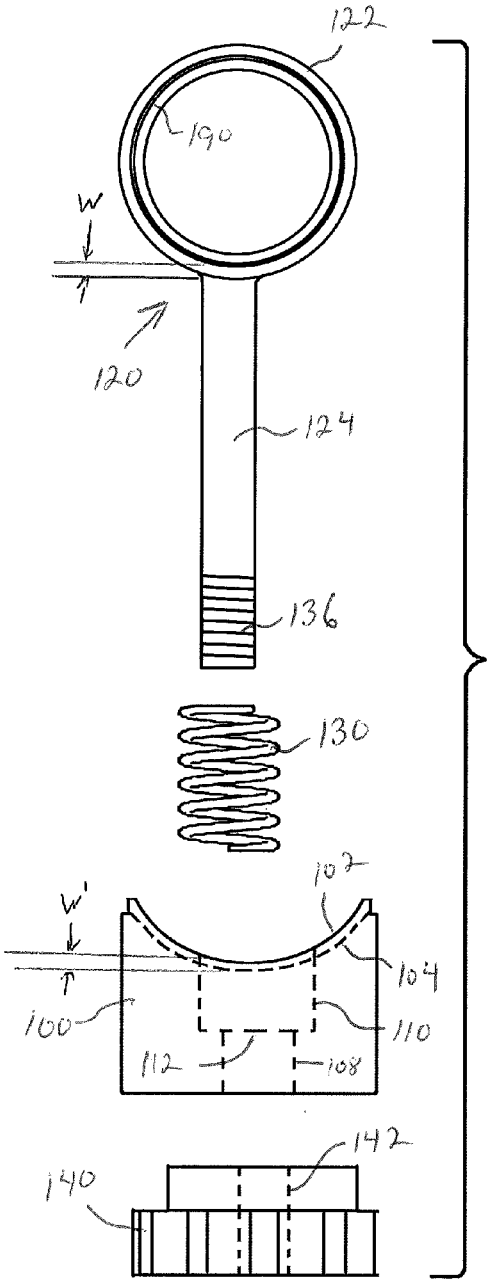
FIG. 11 is an exploded front view of the fastening assembly shown with an attached cylindrical member.
Figure 12:
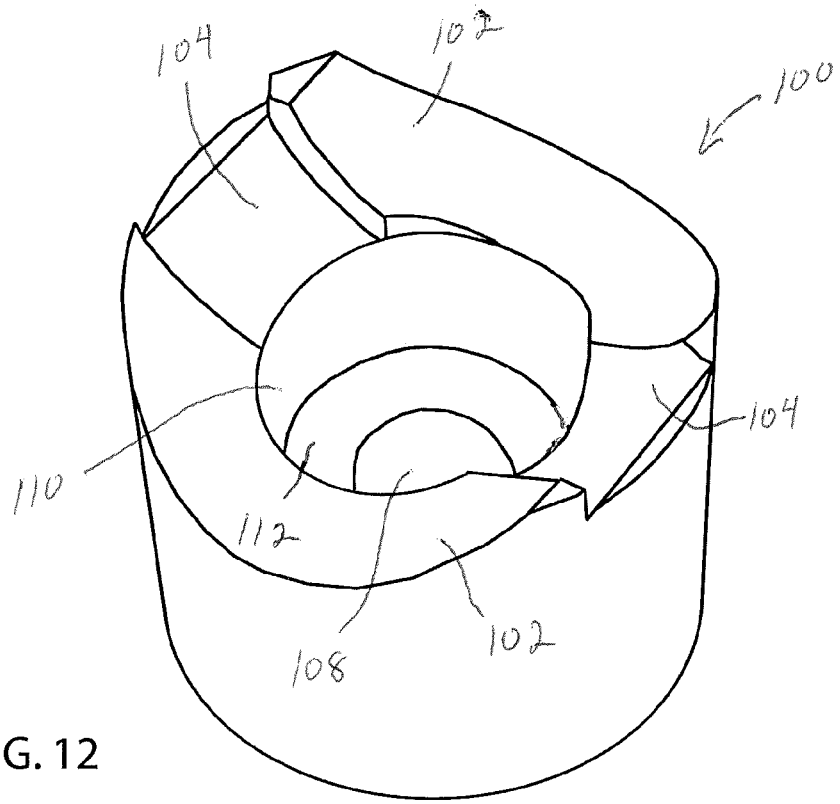
FIG. 12 is a perspective view of the fastening assembly riser according to the present invention.
Figure 13:
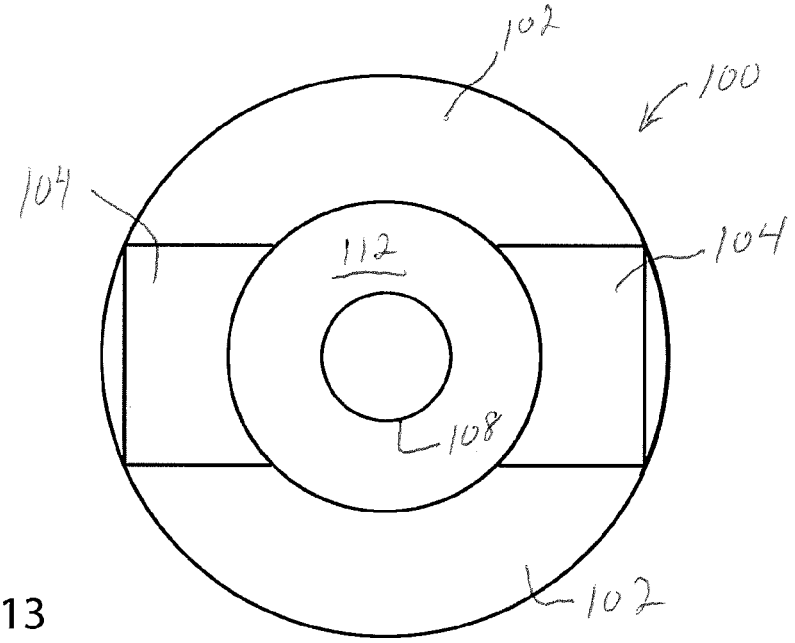
FIG. 13 is a top elevational view of the fastening assembly riser shown in FIG. 12.

In one embodiment of the pivot clamp, an improved fastening system is shown in the exploded views of FIGS. 10 and 11. The fastening assembly may be used for securing a cylindrical member 190 to a surface 160 such as fastening the upright tubular member 32 to the cross member 20. The fastening assembly includes, as shown in FIGS. 12 and 13, a cylindrical riser 100 having a central opening 108 extending axially through the length of the cylinder and a circular aperture 110 having a diameter larger than diameter of the central opening 108. The cylindrical riser may be metal, polymer, composite or any material which provides sufficient strength to secure the cylindrical member to the surface. The circular aperture 110 extends from a top end of the cylindrical riser 100 to a distance less than the length of the cylindrical riser 100. The cylindrical riser 100 includes a first substantially cylindrical groove 102 extending across the top surface of the cylindrical riser 100 and a second substantially cylindrical groove 104 co-axially aligned with and inset into the first cylindrical groove 102 and having a diameter larger than the first cylindrical groove 102. The substantially cylindrical grooves 102, 104 have walls that conform to the exteriors of a cylindrical member 190 and cylindrical ring 122, respectively, when the longitudinal axes of the member 190 and ring 122 are oriented perpendicular to the longitudinal axis of riser opening 108. The length of first substantially cylindrical groove 102 is across the entire width or diameter of riser 100, and the length of the inset second substantially cylindrical groove 104 is less, and may be as or slightly longer than the length of cylindrical ring 122 discussed further below.

Figure 14:
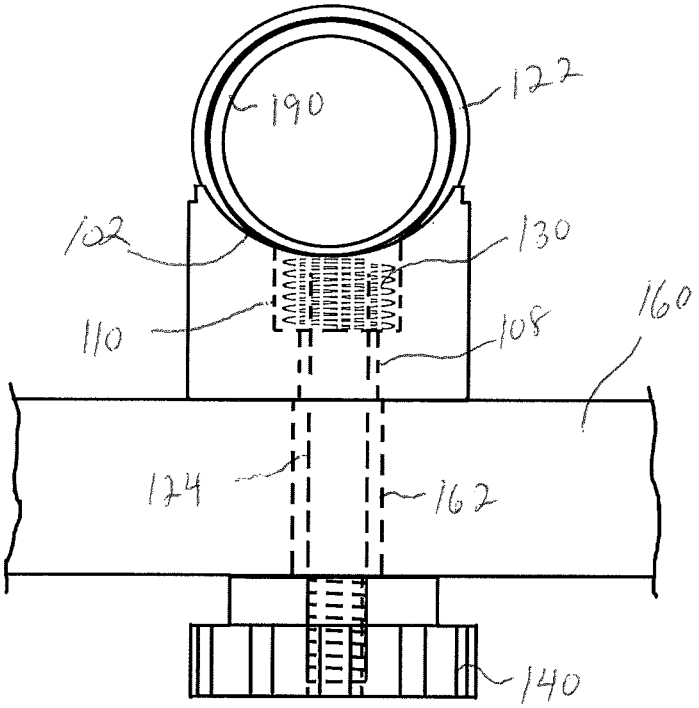
FIG. 14 is a front elevational view of the fastening assembly securing a cylindrical member to a surface with the fastening assembly in the tightened position.
Figure 15:
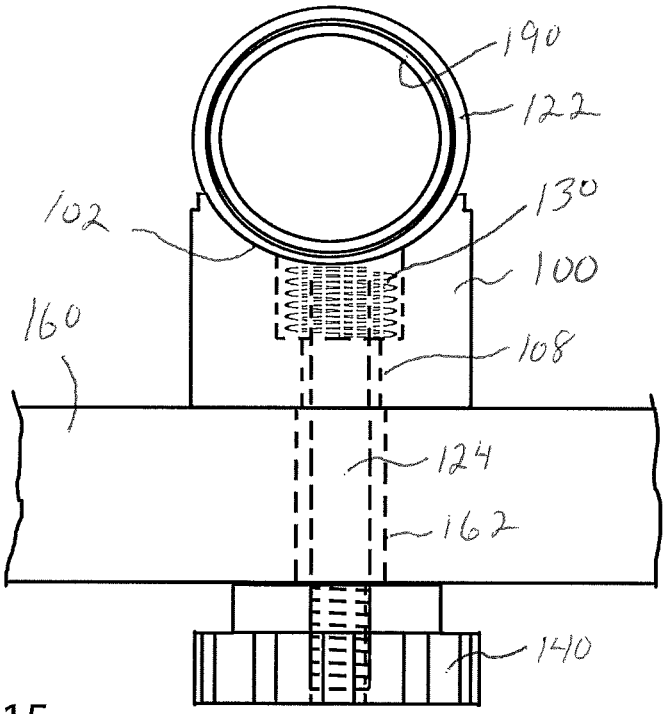
FIG. 15 is a front elevational view of the fastening assembly securing a cylindrical member to a surface with the fastening assembly in the loosened position.

The fastening system includes a spring 130 disposed in the aperture 110. The bottom of the circular aperture 110, includes a seat 112 formed by the end of opening 108 for engaging and supporting the bottom end of spring 130. The fastening system includes a ring 122 having a shaft 124 extending radially from an arc of the ring 122, the shaft 124 including external threads 136 at the end opposite the ring 122. As shown in FIGS. 14 and 15, the shaft 124 extends through the spring 130, the cylindrical riser central opening 108 and a surface opening 162 of the surface 160 to which a cylindrical member 190 is secured. A tension knob 140 is engagable with the treads 136 of the shaft 124 to secure the cylindrical member 190 to the surface 160. The ring 120 is fully engaged with and seated in the second cylindrical groove 104 when the fastening assembly is in a tightened position and the ring 120 is partially engaged with the second cylindrical groove 104 when the fastening assembly is in a loosened position. The cylindrical member 190 may be rotatable about the opening 162 in the surface 160 when the fastening assembly is in the loosened position and the cylindrical member 190 is non-rotatably secured to the surface 160 when the fastening assembly is in the tightened position.

FIGS. 14 and 15 show how the cylindrical member 190 is secured to the surface 160. In the tightened position, since the thickness w of the ring 122 is less than the depth w' of the riser groove 104 as shown in FIG. 11, the ring 122 is engaged in the riser groove 104 with a portion of the ring 122 inside diameter below the groove 102. In this position, the shaft 124 urged downward by the tension knob 140 pulling the ring 122 downward and the ring 122 pulls downward on the cylindrical member 190. This force allows a bottom portion of the cylindrical member 190 to be forced against the groove 102, preventing the cylindrical member 190 from sliding inside the ring. Additionally, the ring is engaged in the groove 104, preventing the ring 122 and the cylindrical member 190 from rotating about the shaft 124. In the loosened position of FIG. 15, the inside diameter of the ring 122 is fully above the groove 104 while a portion the outside diameter of the ring 122 is inside of groove 104. In this position the cylindrical member 190 is allowed to slide inside the ring 122 but may not rotate about the shaft 124. As the fastening assembly is further loosened, the ring 122 is pushed out of the groove 104 by the spring 130, allowing the cylindrical member to rotate about shaft 124.

A method of using the fastening assembly shown in FIGS. 14 and 15 includes a user ensuring the ring shaft 124 extends through the spring 130, riser opening 108 and the opening 162 in the surface 160. The user engages the tension knob 140 with the threads 136 of the shaft 124 and slides the cylindrical member 190 through the ring 122. The user tightens the tension knob 140 until the cylindrical member 190 is prevented from sliding through the ring 122 and the rotating about the surface opening 162. The user may partially loosen the tension knob 140 to allow the cylindrical member 190 to slide through the ring 122 and rotate about the surface opening 162.

The present invention as describe above provides a ladder safety system which allows a user to have additional support to safely dismount the ladder from the top of the ladder. The present invention also provides the user with the stability and confidence to make a smooth, safe transition from the ground or base level to firm footed position on an elevated surface. Stability while using the ladder as the platform while performing specific tasks is also provided. The present invention also provides a ladder safety system which when not in use, collapses to a compact footprint for transport and storage as well as providing a ladder safety system which allows a user to adjust the position of hand rails above the top of the ladder. The present invention also provides a fastener assembly which secures a cylindrical member to a surface in a rotatable or non-rotatable state While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A collapsible ladder safety system for a ladder having first and second vertical ladder rail and a plurality of step rungs extending between the first and second vertical rails, the system comprising:

first and second upright tubular hand rails; and a cross member pivotally attached at a first location to the first upright tubular handrail and at a second location to the second upright tubular handrail for rotation about a pair of parallel axes spaced apart and normal to the upright tubular hand rails, the tubular hand rails or cross member being releasably securable to an upper end of the ladder;

wherein the first and second upright tubular hand rails are collapsible by rotation about the axes to a position substantially parallel to the cross member when not secured to the ladder so the safety system may be easily stored or transported.

2. The collapsible ladder safety system of claim 1 including a curved portion at an upper end of the first and second upright tubular hand rail.

3. The collapsible ladder safety system of claim 1 including a first and second pair of pivot clamps detachable from the cross member, the pivot clamps including a circular sleeve slidingly attached to the upright tubular member and a pin extending outward from the circular sleeve into an opening on the cross member, the circular sleeve allowing axial rotation of the upright tubular members and the pin allowing rotation of the upright tubular members about the pin.

4. The collapsible ladder safety system of claim 3 including a tension knob attached to each pivot clamp for adjusting the friction between the circular sleeve and the upright tubular member.

5. The collapsible ladder safety system of claim 1 including a lower brace member pivotally attached to each of the first and second upright tubular members, the lower brace member being parallel to the cross member.

6. The collapsible ladder safety system of claim 1 wherein the first and second upright tubular members are nearly parallel to the cross member when the system is in a closed position and the first and second upright tubular hand rails are perpendicular to the cross member when the system is an opened position with the upright tubular hand rails fully secured to the ladder.

7. The collapsible ladder safety system of claim 1 including a support arm extending from each end of the cross member toward a surface for which the ladder is meant to lean against.

8. A collapsible ladder safety system for a ladder having first and second vertical ladder rail and a plurality of step rungs extending between the first and second vertical rails, the system comprising:

first and second upright tubular hand rails;

a curved portion at an upper end of the first and second upright tubular hand rail;

a cross member pivotally attached at a first location to the first upright tubular handrail and at a second location to the second upright tubular handrail for rotation about a pair of parallel axes spaced apart and normal to the upright tubular hand rails, the tubular hand rails or cross member being releasably securable to an upper end of the ladder;

a support arm extending from each end of the cross member toward a support wall for which the ladder is meant to lean against;

a lower brace member pivotally attached to each of the first and second upright tubular members, the lower brace member being parallel to the cross member;

a first and second pair of pivot clamps, the pivot clamps including a circular sleeve slidingly attached to the upright tubular member and a pin extending outward from the circular sleeve into an opening on the cross member or the lower brace; and a tension knob attached to each pivot clamp for adjusting the friction between the circular sleeve and the upright tubular member;

wherein the first and second upright tubular members are rotatable about the axes to a position nearly parallel to the cross member when the system is in a closed position for storage or transportation and the first and second upright tubular hand rails are perpendicular to the cross member when the system is an opened position.

9. The collapsible ladder safety system of claim 8 wherein the cross member is attachable to the ladder rails.

10. The collapsible ladder safety system of claim 8 wherein the cross member is attachable to at least one of the ladder step rungs.

11. The collapsible ladder safety system of claim 8 wherein the upright tubular hand rails are rotatable within the circular sleeve and rotation tension is adjustable with the tension knob.

12. The collapsible ladder safety system of claim 8 wherein the upright tubular hand rails are vertically slidable within the circular sleeve and slide tension is adjustable with the tension knob.

13. The collapsible ladder safety system of claim 8 wherein the upright tubular hand rails extend below the support arms and are spaced away from the ladder rails sufficient for a user to grasp around the entire circumference of the tubular hand rail.

14. The collapsible ladder safety system of claim 8 wherein the upright tubular hand rails extend below the lower brace member.

15. A method for using the collapsible ladder safety system according to claim 8, the method comprising:

providing the first and second parallel upright tubular hand rails, the curved portion at the upper end of the first and second parallel upright tubular hand rail, the cross member pivotally attached to each of the first and second upright tubular hand rails, the support arm extending from each end of the cross member toward the support wall for which the ladder is meant to lean against, the lower brace member pivotally attached to each of the first and second upright tubular hand rails, the lower brace member being parallel to the cross member, the first and second pair of pivot clamps, the pivot clamps including the circular sleeve slidingly attached to the upright tubular member and the pin extending outward from the circular sleeve into an opening on the cross member or the lower brace and the tension knob attached to each pivot clamp for adjusting the friction between the circular sleeve and the upright tubular hand rail;

moving the first and second upright tubular hand rails from a closed position wherein the first and second upright tubular hand rails are nearly parallel to the cross member to a second open position wherein the first and second upright tubular hand rails are perpendicular to the cross member;

securing the first and second upright tubular hand rails or the cross member to an upper portion of the ladder;

placing the support arms against a wall or roof; and adjusting the first and second parallel upright tubular hand rails to provide support for a user.

16. The method of claim 15 including the step of removing the first and second upright tubular hand rails or the cross member from the upper portion of the ladder when the user is finished using the ladder.

17. The method of claim 16 including the step of moving the first and second upright tubular hand rails from the second position to the first closed position.

* * * * *